US005161799A

United States Patent [19]

Nandra

[11] Patent Number: 5,161,799

[45] Date of Patent: Nov. 10, 1992

[54] HOCKEY PRACTICE APPARATUS KIT

[76] Inventor: Mukhtar S. Nandra, 103 8th Ave. SW., Crosby, N. Dak. 58730

[21] Appl. No.: 837,950

[22] Filed: Feb. 20, 1992

[51] Int. Cl.[5] ..... A63B 67/04

[52] U.S. Cl. ..... 273/57.2; 273/200 B; 273/185 D; 273/26 R

[58] Field of Search ..... 273/26 R, 184 B, 185 R, 273/196, 200 A, 200 B, 126 R, 57.2

[56] References Cited

U.S. PATENT DOCUMENTS

| | | | |
|---|---|---|---|
| 1,581,402 | 4/1926 | Penfrase | 273/200 B |
| 1,973,424 | 9/1934 | Albera | 273/26 R |
| 1,991,252 | 2/1935 | Kane | 273/185 D |
| 3,709,489 | 1/1973 | Hollerman | 273/57.2 |
| 3,830,504 | 8/1974 | Koo | 273/185 D |
| 3,937,464 | 2/1976 | Zalewski | 273/26 R |
| 3,955,815 | 5/1976 | Deschesnes | 273/200 B |
| 4,070,017 | 1/1978 | Lombardi | 273/57.2 |
| 4,607,842 | 8/1986 | Daoust | 273/57.2 |
| 4,662,641 | 5/1987 | Peyret | 273/200 B |

*Primary Examiner*—Theatrice Brown
*Attorney, Agent, or Firm*—Leon Gilden

[57] ABSTRACT

A readily transportable and positionable practice kit, including a unitary track defining an enclosed slot, with the track including plural pairs of support plates positioning the track in a spaced relationship relative to an underlying support. The enclosed track slidably receives an axle therethrough, wherein the axle is orthogonally mounted to a hockey puck at an upper terminal end of the axle slidably mounted within the track to effect rebounding of the puck when projected against a return spring.

2 Claims, 4 Drawing Sheets

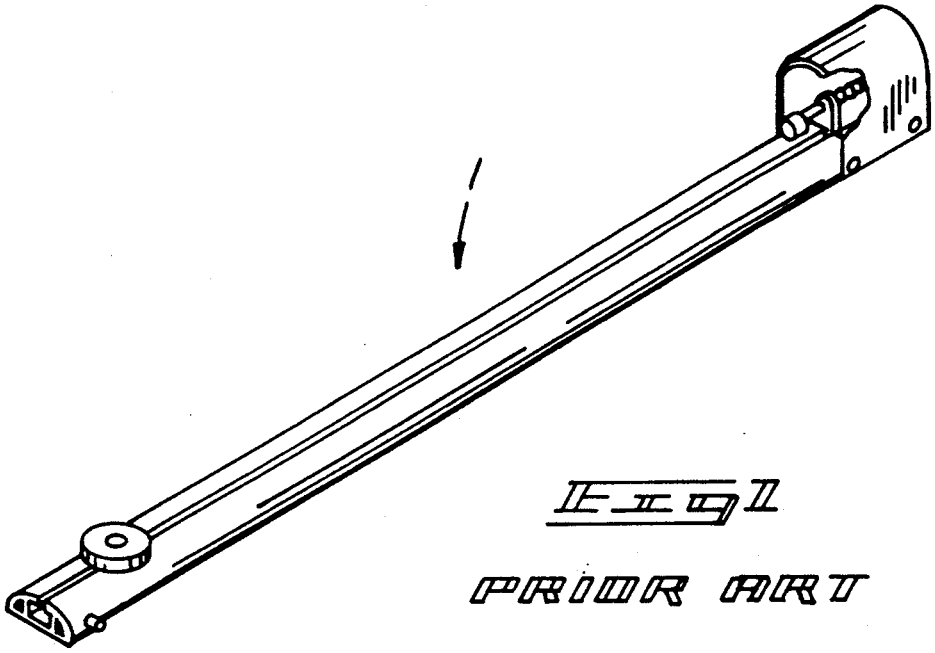
Fig 1
PRIOR ART
Fig 2
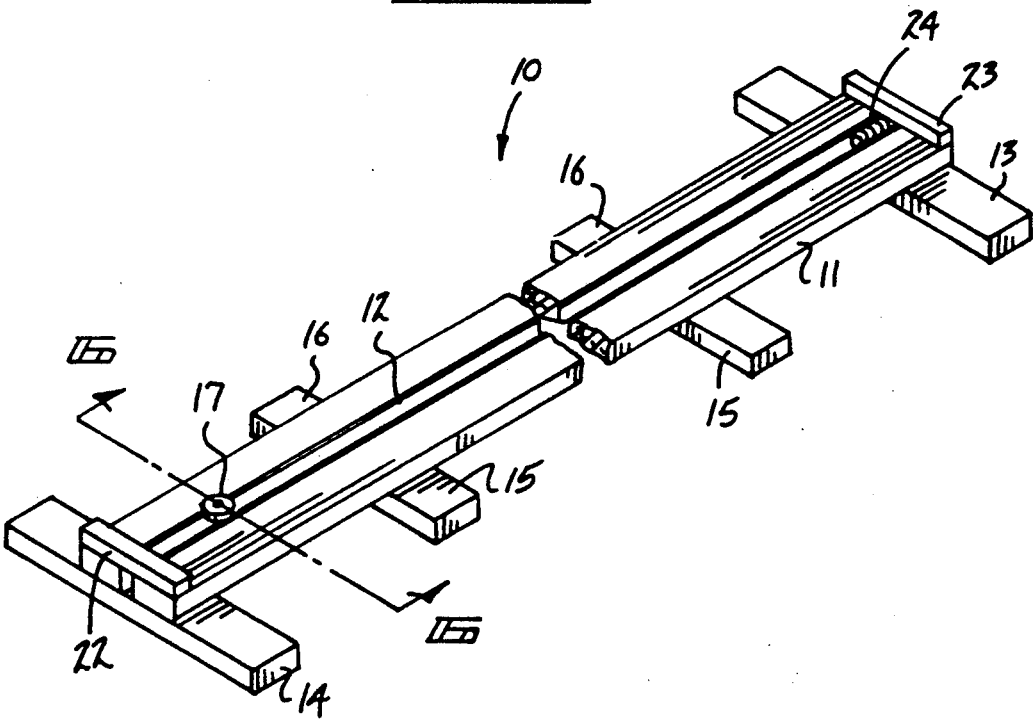

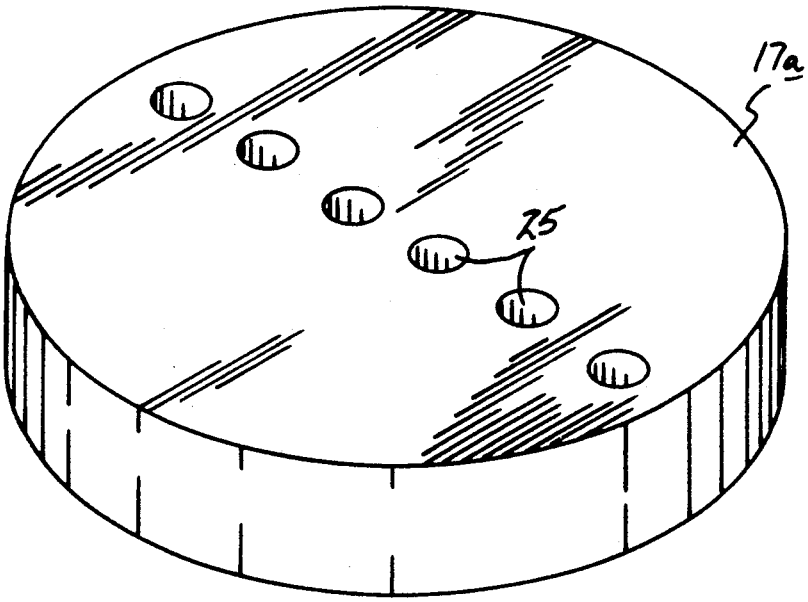
Fig 5
Fig 6
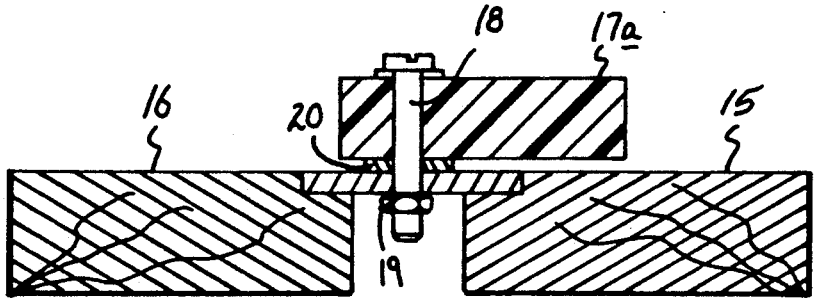

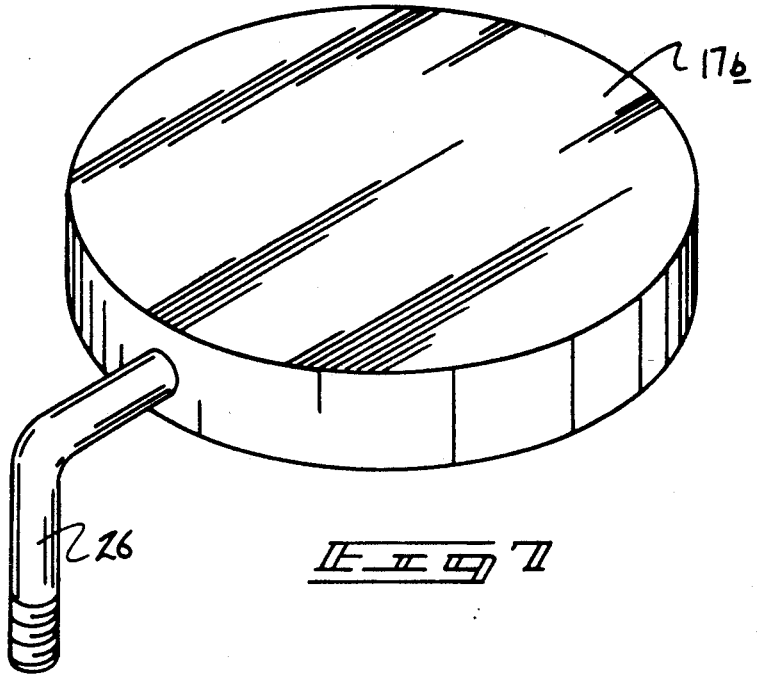
FIG 7
FIG 8
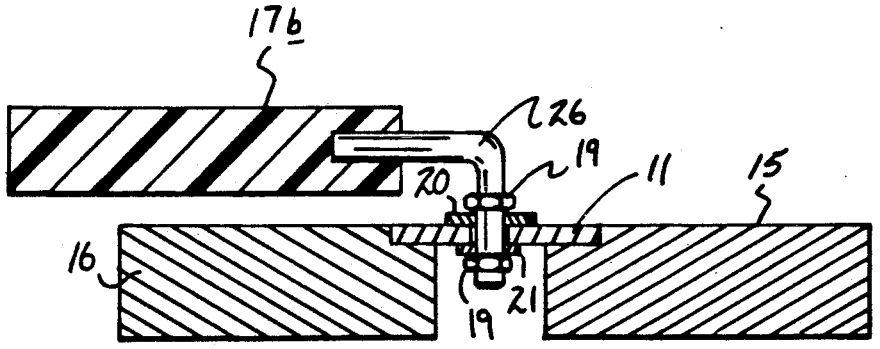

HOCKEY PRACTICE APPARATUS KIT

BACKGROUND OF THE INVENTION

1. Field of the Invention

The field of invention relates to a hockey practice organization, and more particularly to a hockey practice apparatus kit wherein the same effects return of a hockey puck to an initial orientation permitting rapid successive impact of the hockey puck to enhance hand and eye coordination in use.

2. Description of the prior Art

Various structures have been utilized in the prior art to provide practice in various athletic events and imparticularly to hockey shooting devices to permit an individual to practice a sport between intervals of game play. Such devices are found for example in U.S. Pat. No. 4,070,017 to Lombardi setting forth a resiliently rebounding hockey puck mounted within a track.

U.S. Pat. No. 3,955,815 to Deschesnes sets forth a hockey training device directing a hockey puck along a slotted track.

U.S. Pat. No. 4,607,842 to Daoust provides for a hockey puck to be impacted against a back board positioned in a remote orientation relative to a starting position for the hockey puck.

U.S. Pat. No. 3,709.489, to Holleran, et al. sets forth a hockey skill practice device wherein various positions within a framework provides for various obstacles in enhancing hand and eye coordination in impacting of a hockey puck.

As such, it may be appreciated that there continues to be a need for a new and improved hockey practice apparatus kit as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of hockey practice devices now present in the prior art, the present invention provides a hockey practice apparatus kit wherein the same provides for an apparatus utilizing various hockey pucks mounted upon a track to provide various trajectories of the hockey puck subsequent to impact and return to an initial starting position. As such, the general purpose of the present invention, which will be described subsequently in greater detail, is to provide a new and improved hockey practice apparatus kit which has an the advantages of the prior art hockey practice apparatus and none of the disadvantages.

To attain this, the present invention provides a readily transportable and positionable practice kit, including a unitary track defined an enclosure slot, with the track including plural pairs of support plates positioning the track in a spaced relationship relative to an underlying support. The enclosed track slidably receives an axle therethrough, wherein the axle is orthogonally mounted to a hockey puck at an upper terminal end of the axle slidably mounted within the track to effect rebounding of the puck when projected against a return spring.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar With patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved hockey practice apparatus kit which has all the advantages of the prior art hockey practice apparatus and none of the disadvantages.

It is another object of the present invention to provide a new and improved hockey practice apparatus kit which may be easily and efficiently manufactured and marketed.

It is a further object of the present invention to provide a new and improved hockey practice apparatus kit which is of a durable and reliable construction.

An even further object of the present invention is to provide a new and improved hockey practice apparatus kit which is susceptible of a low cost of manufacture with regard to both materials and labor, and which accordingly is then susceptible of low prices of sale to the consuming public, thereby making such hockey practice apparatus kits economically available to the buying public.

Still yet another object of the present invention is to provide a new and improved hockey practice apparatus kit which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an isometric illustration of a prior art hockey practice apparatus.

FIG. 2 is an isometric illustration of the instant invention.

FIG. 5 shows a modified disk member having a plurality of apertures along a diameter thereof.

FIG. 6 shows the disk of FIG. 5 eccentrically mounted on the track.

FIG. 7 and 8 shows modified forms of the disk member.

DESCRIPTION OF THE PREFERRED EMBODIMENT

Figure 3:
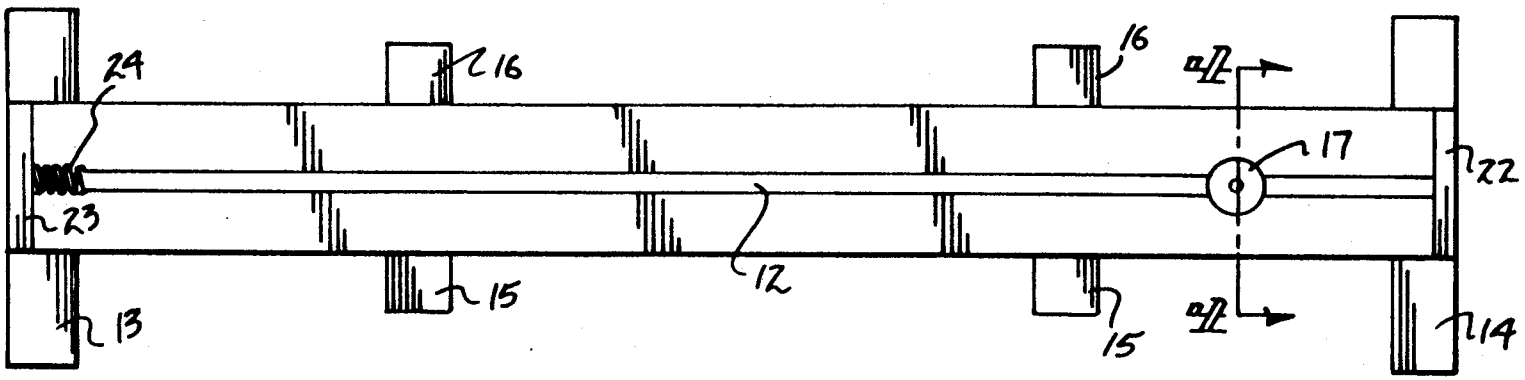
FIG. 3 is an orthographic top view of the instant invention.
Figure 4:
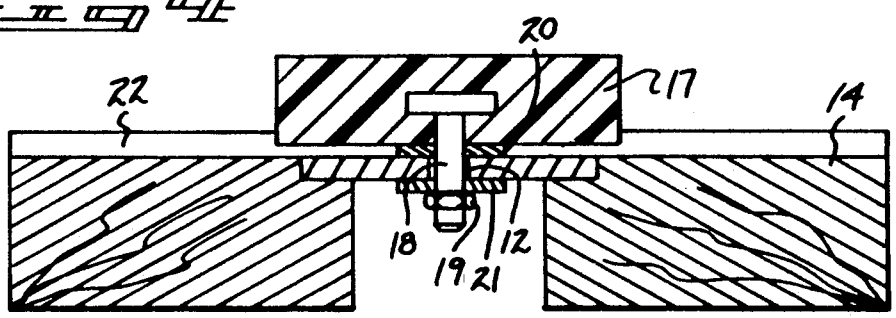
FIG. 4 is an orthographic view, taken along the lines 4—4 of FIG. 3 in the direction indicated by the arrows.

With reference now to the drawings, and in particular to FIGS. 1 to 4 thereof, a new and improved hockey practice apparatus kit embodying the principles and concepts of the present invention and generally designated by the reference numeral 10 will be described.

FIG. 1 sets forth a prior art hockey practice apparatus, as indicated and discussed in U.S. Pat. No. 4,070,017, providing a track structure and a rebound abutment to bias the hockey puck back initial position upon striking of the rebound abutment, as illustrated and discussed within the patent.

More specifically, the hockey practice apparatus kit 10 of the instant invention essentially comprises an elongate longitudinally aligned support track 11, defined by a planar top surface, with a medially and longitudinally aligned enclosed slot 12 directed coextensively of the track 11. A rear end plate 13 and a forward end plate 14 space the support track above a surface, with spaced pairs of medial support plates defined by aligned first and second support plates 15 and 16 respectively that position the first and second support plates 15 and 16 in aligned relationship orthogonally relative to the slot 12 to provide support and spacing of the track relative to an underlying support. A first hockey puck 17 defined as a cylindrical disk is provided, with an axle 18 mounted orthogonally as well as coaxially of the puck, and with the axle 18 directed through the slot, including a fastener 19 mounted to a lower terminal end of the axle to maintain the axle within the slot, with spaced upper and lower spacer disks 20 and 21 mounted in contiguous communication with respective upper and lower surfaces of the support track to minimize friction of the hockey puck as it is directed along the track 11. A rear abutment plate 22 and a forward abutment plate 23 contain the puck within the slot as the abutment plates are mounted to the top surface of the track and are spaced to provide abutment surface to permit the hockey puck from removal from the track structure as the abutment plates are orthogonally aligned relative to the slot 12, as illustrated in FIG. 2 for example. Spring member 24 is mounted medially of an interior surface of the forward abutment plate 23 and aligned with the slot 12 and spaced above the top surface of the track 11 to provide a rebound spring for displacing and rebounding the puck 17 to its original position when struck by a hockey stick (not shown).

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A hockey practice apparatus kit, comprising in combination, a support track, said support track defining a slot, said track having a top surface and a bottom surface, a plurality of support plates mounted to the track bottom surface to space a bottom surface above the support surface, a forward abutment plate mounted on said top surface and on a forward end of the support track, and a rear abutment plate mounted on said top surface and on a rear end of the support track wherein the rear and forward abutment plates are oriented orthogonally relative to the slot, the forward abutment plate having a rebound spring member fixedly attached thereto and medially mounted to the forward abutment plate, with the rebound spring member being positioned in parallel spaced relationship relative to the slot and positioned above the slot, a plurality of cylindrical disk members, each of said disk members being selectively and slidably mounted on said support track top surface for sliding engagement on said top support track top surface.

2. An apparatus as set forth in claim 1 wherein each cylindrical disk member for a shaft attached thereto, said shaft being coaxially directed through the first cylindrical said disk member, central shaft positionable said shaft extending through said slot and housing including a lower fastener to mount the axle to the slot, a lower spacer disk positioned between the lower fastener and said support track bottom surface, and an upper spacer disk mounted between the support track top surface and said cylindrical disk member.

* * * * *